United States Patent [19]

Kuehn

[11] 4,453,657

[45] Jun. 12, 1984

[54] DISPENSING PACKAGE FOR ROLLED SHEET MATERIAL

[76] Inventor: Joseph R. Kuehn, Rte. 1, Black Earth, Wis. 53515

[21] Appl. No.: 418,993

[22] Filed: Sep. 16, 1982

[51] Int. Cl.[3] ..... B65D 85/672

[52] U.S. Cl. ..... 225/65; 225/66

[58] Field of Search ..... 225/65, 66, 56, 67–71

[56] References Cited

U.S. PATENT DOCUMENTS

| | | | |
|---|---|---|---|
| 897,086 | 8/1908 | Grand | 225/56 X |
| 1,208,968 | 12/1916 | Hudgel | 225/68 |
| 1,351,555 | 8/1920 | Cranshaw | 225/67 |
| 3,134,526 | 5/1964 | Schleicher | 225/65 X |

FOREIGN PATENT DOCUMENTS

| | | | |
|---|---|---|---|
| 736499 | 9/1955 | United Kingdom | 225/26 |

*Primary Examiner*—Frank T. Yost

*Attorney, Agent, or Firm*—Isaksen, Lathrop, Esch, Hart & Clark

[57] ABSTRACT

A dispensing package (10) adapted to be mounted on a tubular roll (12) of sheet material (13) to be dispensed therefrom, the roll (12) having ends (16) and a hollow core (18). The dispensing package (10) includes a unitary, molded plastic body (20) selected to be substantially as long as the roll (12) and having upper and under surfaces (22, 24). The under surface (24) includes an arcuate contact surface (26) adapted to slidingly engage a portion of the circumference of the roll (12). The contact surface (26) extends to first and second side edges (28, 30), at least one of which is a cutting edge (32) extending generally parallel to the axis of a roll (12) engaged in the dispensing package (10). Opposed body ends (40) extend generally radially over the ends of the roll (12), and a roll retainer (42) extends from each body end (40) toward the opposed body end (40). The roll retainers (42) are adapted to extend into the hollow core (18) of a roll (12) to retain it within the body (20).

6 Claims, 4 Drawing Figures

DISPENSING PACKAGE FOR ROLLED SHEET MATERIAL

TECHNICAL FIELD

The present invention relates to dispensers for rolled sheet material in general and, in particular, to such dispensers adapted to serve as a package for the roll.

BACKGROUND OF PRIOR ART

The prior art is generally cognizant of dispensers for rolled sheet material adapted to be mounted on or carried by the roll. See for example, U.S. Pat. Nos. 1,726,312; 1,915,736; 1,952,431; 3,173,591; and 3,559,857. The devices shown in each of the patents cited include a bar or other body extending the length of the roll. The sheet material is drawn back across a cutting edge on the bar to be cut. The bars are held to the roll by tabs or comparable structures extending into the hollow core of the roll.

The prior art dispensers are designed to be made of relatively rigid materials, typically metal. The cutting bar typically is substantially flat and is adapted to be held against the roll usually by the user's thumb as the roll and dispenser are grasped in the hand.

The prior art does not show a roll mounted dispensing package for rolled sheet material adapted for manufacture from thin and relatively flexible materials. Furthermore, prior art devices are not adapted to be both constructed as a unitary object and easily snapped over a roll of sheet material without considerable bending of the cutting bar or other significant manipulation.

BRIEF SUMMARY OF THE INVENTION

The present invention is summarized in that a dispensing package adapted to mounted on a tubular roll of sheet material to be dispensed therefrom, the roll having ends and interior surfaces defining a hollow core, includes a unitary, molded plastic body selected to be substantially as long as the roll. The body has upper and under surfaces, the under surface including a contact surface adapted to slidingly engage a portion of the circumference of the roll. The contact surface extends to a cutting edge that is generally parallel to the axis of a roll engaged by the contact surface. An upwardly projecting back rib extends lengthwise along the body. Opposed body ends extend generally radially inward from the contact surface and are adapted to extend over the ends of a roll engaged by the contact surface. A roll retainer extends from each body end toward the opposed body end and is adapted to extend into the hollow core of a roll to retain the roll within the body.

A primary object of the invention is to provide a dispensing package for rolled sheet material adapted for simple manufacture as a rigid unitary object from relatively thin and flexible material, such as thermoformable plastics.

A second object of the invention is to incorporate in the design of such a dispensing package a handle member adapted to facilitate the manipulation of the package.

Another object of the invention is to provide such a dispensing package adapted to hold the roll in such a way that it turns freely within the package without making contact with any sharp or snagging surface.

Other objects, features, and advantages of the invention will be apparent from the following detailed description taken in conjunction with the accompanying drawings showing a preferred embodiment of a dispensing package for rolled sheet materials exemplifying the principles of the invention.

DETAILED DESCRIPTION OF THE PREFERRED EMBODIMENT

Figure 1:
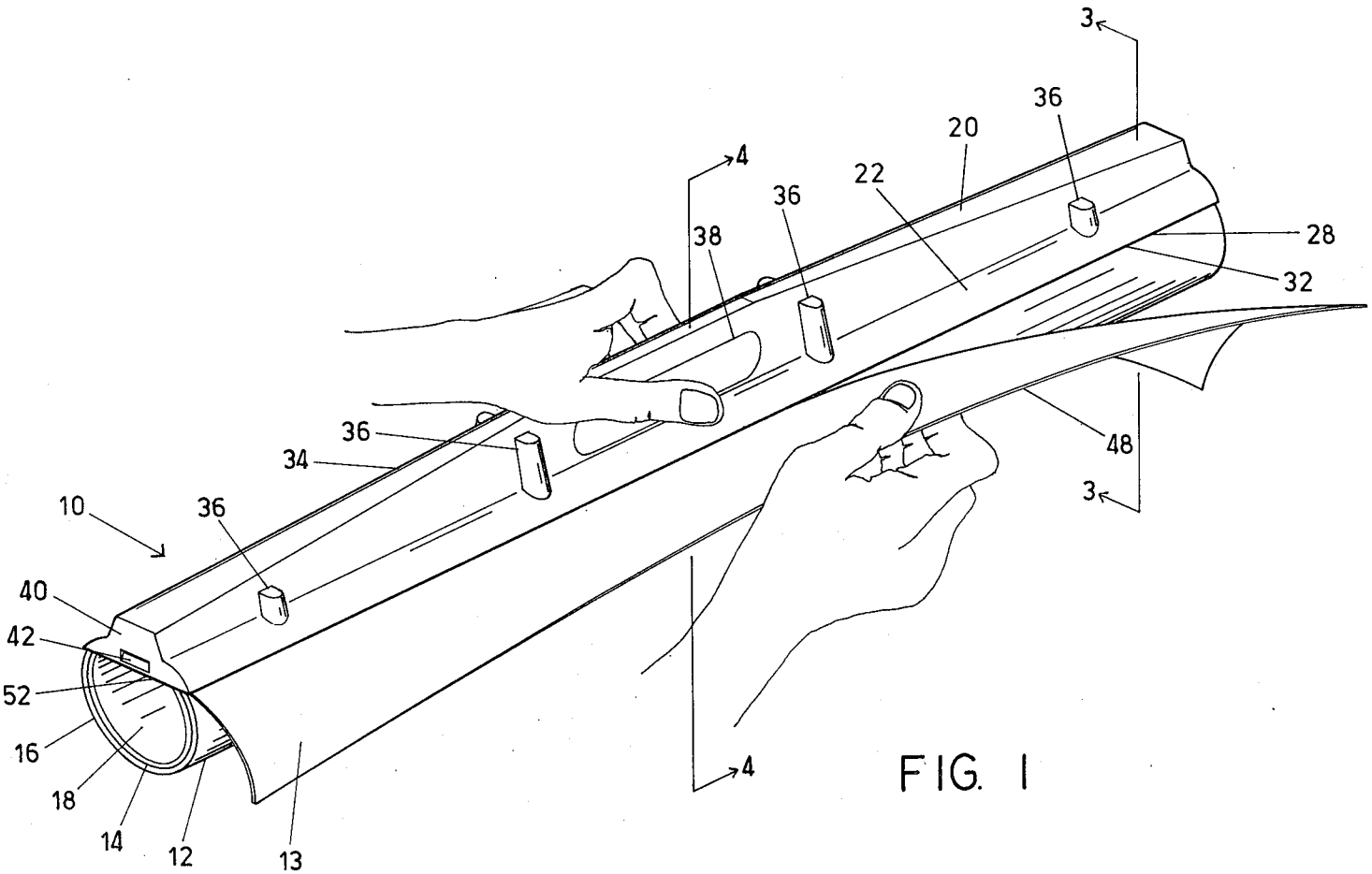
FIG. 1 is a perspective view of a dispensing package for rolled sheet materials constructed in accord with the present invention and mounted on a roll of sheet material.
Figure 2:
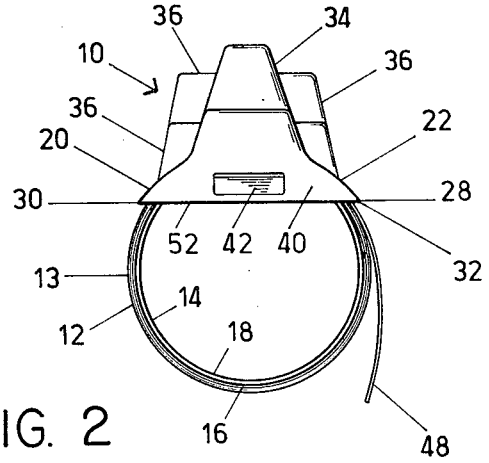
FIG. 2 is an end elevation view of the dispensing package of FIG. 1.
Figure 3:
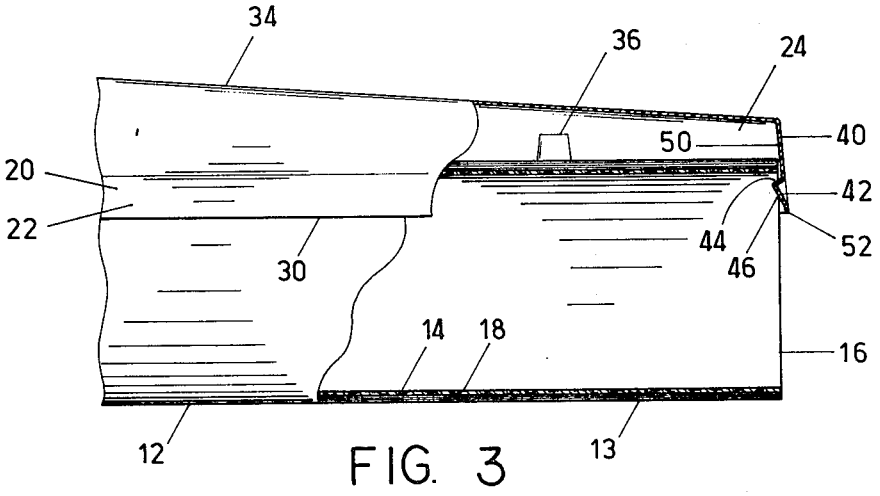
FIG. 3 is a side elevation view of one end of the dispensing package of FIG. 1 with a portion of the dispensing package and roll broken away to reveal a section taken along section lines 3—3.

Referring more particularly to the drawings, wherein like numbers refer to like parts, FIGS. 1 and 2 show a dispensing package for rolled sheet materials, generally indicated at 10, made in accord with the present invention. The dispensing package 10 is adapted to be mounted on a tubular roll 12 of sheet material 13, such as paper, plastic wrap, or any rollable sheet material that may be cut or torn along a cutting edge, as is disclosed below. The roll 12 may be wound on a tubular base 14 if the sheet material 13 does not have sufficient strength to maintain a substantially rigid tubular configuration when rolled. The tubular roll 12 has ends 16 and interior surfaces defining a hollow core 18.

Figure 4:
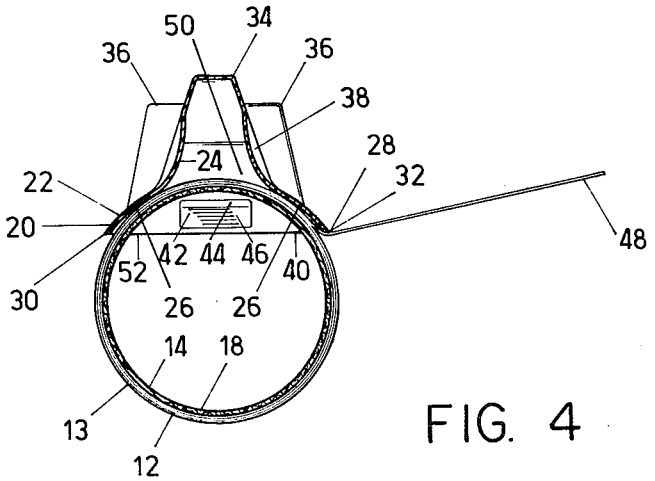
FIG. 4 is a section view of the dispensing package of FIG. 1 taken along section lines 4—4.

The dispensing package 10 has a body 20 selected to be substantially as long as the roll 16. Preferably, the body 20 is unitary and molded from plastic. The body 20 has an upper and an under surface 22, 24. The under surface 24 includes a contact surface 26. The contact surface 26 preferably is arcuate and is adapted to engage a portion of the circumference of a roll 12 when the dispensing package 10 is mounted thereon. The contact surface 26 extends to first and second side edges 28, 30 and may be continuous or interrupted, as is best illustrated in FIG. 4. The side edges 28, 30 extend longitudinally for substantially the length of the body 20. At least one of the side edges 28, 30 is a cutting edges 32 that extends generally parallel to the axis of the roll 12 and is adapted to cut, tear, or otherwise sever sheet material 13 pulled against it with selected force.

An upwardly projecting back rib 34 extends lengthwise along the body 20, preferably extending substantially the entire length thereof. The back rib 34 functions in part to render the body 20 more rigid. To the same end, in the preferred embodiment a selected number of braces 36 extend laterally from the back rib 34 to brace it against other parts of the body 20.

The back rib 34 has a selected first width at the extreme ends thereof. The back rib 34 then narrows to a second width generally midway along the back rib 34. The back rib 34 projects upwardly further as it becomes narrower. A handle 38 adapted to be grasped by a user's hand may conveniently be formed in the back rib 34, preferably at its narrowest part, as is best illustrated in FIGS. 1 and 4. Preferably the handle 38 is inwardly indented to provide a finger grip.

Opposed body ends 40 extend generally radially and inwardly from the arcuate contact surface 26. The body ends 40 are adapted to extend over the ends 16 of a roll 12 engaged by the contact surface 26. A roll retainer 42 extends from each body end 40 toward the opposed body end. The roll retainers 42 are adapted to extend into the hollow core 18 of the roll 12 to retain the roll within the body 20. Preferably, each roll retainer 42 has a retaining surface 44 generally presented toward the contact surface 26. Each roll retainer 42 also has a deflecting surface 46, presented away from the contact surface 26. The deflecting surface 46 extends from the body end 40 toward the contact surface 26 at an acute angle to the body end. The body ends 40, and preferably the entire body 20, are made of a resilient, flexible material. Thus, a roll 12 may the thrust into the dispensing package 10 and against the deflecting surfaces 46 of the roll retainers 42, forcing the body ends 40 outwardly until the roll retainers 42 snap into the hollow core 18 to retain the roll within the body.

In its operation, the dispensing package 10 is mounted on a tubular roll 12 of sheet material 13 in the manner disclosed above. A desired amount of the sheet material 13 on the roll 12 may be withdrawn by the user, who may conveniently hold the dispenser 10 by the handle 38 and simply pull the desired amount of sheet material from the roll 12. As the roll 12 turns within the dispenser 10, the contact surface 26 slides over the roll, to leave a free end 48 of the sheet material 13 in the hand of the user. Still holding the dispenser 10 in one hand by the handle 38 and steadying the roll 12 against the under surface 22 with the fingers of the same hand, the user may use his other hand to draw the free end 48 of the sheet material 13 back across the cutting edge 32 to part it from the remainder of the sheet material still on the roll 12, as is illustrated in FIG. 1.

It will be appreciated that it is desirable that the roll 12 be free to slide smoothly within the body 20 as it turns. To help attain that desired end, it is preferred that the arcuate contact surface 26 be smooth and that the curvature of the arcuate contact surface be greater than that of the roll 12. By that means, the roll 12 may rotate against smooth parts of the under surface 24 as the roll turns, without contacting either the first or second side edge 28, 30. similarly, it is preferred that each body end 40 have a smooth inner surface 50 that extends from the back rib 34 and terminates in an end edge 52. The smooth inner surfaces 50 of the body ends 40 incline outwardly as they extend from the back rib 34 toward the end edges 52, so that the parts of the roll 12 contacting the body ends do so against the smooth inner surfaces and not the end edges.

Preferably the dispensing package 10 is unitarily formed of an appropriately strong material. The material used will depend upon the sheet material 13 to be dispensed. When the sheet material 13 is paper, plastic wrap, and the like, the dispensing package 10 may be conveniently formed unitarily of selected plastic sheet material by thermoforming. For the purposes of this disclosure "thermoforming" shall include any method of imparting a shape to a substantially rigid stock material by heating and then stretching, molding, or otherwise altering the shape of the material, which is then allowed to cool and regain its substantially rigid characteristics. However, the dispensing package 10 may also be made by molding or be made nonunitarily by other means and from other materials, all of which are within the scope and spirit of the invention. The dispensing package 10 may be made of a transparent material to reveal the color or pattern of the sheet material 13 to be dispensed. The structure of the dispensing package, as disclosed above, allows relatively thin plastics that present a minimum of visual obstruction nevertheless to be used in making a dispensing package of considerable rigidity and strength. Because such materials are inexpensive and thermoforming a dispensing package 10 from them is likewise an inexpensive process, the dispensing package of the invention can be mounted on and sold with tubular rolls 12 of sheet material 13 at a small fraction of the cost of the sheet material itself. The use of lightweight plastics to make the dispensing package 10 allows the package to be sold with such sheet material with only a negligible increase in the cost of handling and shipping the sheet material so packaged.

It is understood that the present invention is not limited to the particular construction and arrangement of parts disclosed and illustrated herein, but embraces all such modified forms thereof as come within the scope of the following claims.

What is claimed is:

1. A dispensing package adapted to be mounted on a tubular roll of sheet material to be dispensed therefrom, the roll having ends and interior surfaces defining a hollow core, the dispensing package comprising:

(a) a unitary, molded plastic body selected to be substantially as long as the roll and having under and upper surfaces, the under surface including a contact surface adapted to slidingly engage a portion of the circumference of the roll, the contact surface extending to a cutting edge generally parallel to the axis of a roll engaged by the contact surface, and the contact surface being arcuate and having a radius of curvature greater than that of the roll so that the roll may rotate against smooth parts of the under surface as the roll turns, without contacting the cutting edge;

(b) an upwardly projecting back rib extending lengthwise along the body;

(c) opposed body ends extending generally radially inward from the contact surface and adapted to extend over the ends of a roll engaged by the contact surface, each body end having an inner surface that terminates in an end edge and inclines outwardly as it extends from the back rib toward the end edge, so that parts of the roll contacting the body end do so against the inner surface and not the end edge; and (d) a roll retainer extending from each body end toward the opposed body end and adapted to extend into the hollow core of a roll to retain the roll within the body.

2. A dispensing package (10) addapted to be mounted on a tubular roll (12) of sheet material (13) to be dispensed therefrom, the roll (12) having ends (16) and interior surfaces defining a hollow core (18), the dispensing package (10) comprising:

(a) a body (20) selected to be substantially as long as the roll (12) and having upper and under surfaces (22, 24), the under surface (24) including an arcuate contact surface (26) adapted to slidingly engage a selected portion of the circumference of the roll (12), the contact surface (26) having a radius of curvature greater than that of the roll (12) of sheet material (13) and extending to a cutting edge (32) that is generally parallel to the axis of a roll (12) engaged by the contact surface (26);

(b) opposed body ends (40) extending generally radially inward from the arcuate contact surface (26)

over the ends (16) of a roll (12) engaged by the contact surface (26) and terminating in end edges (52), each body end (40) having an inner surface (50) inclining outwardly as it extends from the contact surface (26) to the end edge (52), so that any part of the roll (12) that contacts the body end (40) does so against the inner surface (50) and not the end edge (52);

(c) an upwardly projecting back rib (34) extending lengthwise along the body (20) and including a handle (38) formed in the back rib (34) and adapted to be grasped by the user's hand;

(d) a selected number of braces (36) extending laterally from the back rib (34) to increase the rigidity thereof; and (e) a roll retainer (42) extending from each body end (40) toward the opposed body end (40) and adapted to extend into the hollow core (18) of a roll (12) engaged by the contact surface (26) to retain the roll (12) within the body (20).

3. The dispensing package (10) of claim 2 wherein the back rib (34) has a selected first width nearest the body ends (40) narrowing to a second width generally midway between the body ends (40), the back rib (34) projecting upwardly further as becomes narrower.

4. The dispensing package (10) of claim 2 wherein the body ends (40) are made of resilient, flexible material and each roll retainer (42) has (a) a retaining surface (44) presented toward the contact surface (26) and adapted to retain a roll (12) within the dispensing package (10); and (b) a deflecting surface (46) presented away from the contact surface (26) and extending from the body end (40) toward the contact surface (26) at an acute angle to the inner surface (50) thereof, whereupon a roll (12) may be thrust into the dispensing package (10) against the deflecting surfaces (46), forcing the body ends (40) outwardly until the roll retainers (42) snap into the hollow core (18) to retain the roll (12) within the body (20).

5. The dispensing package (10) specified in claim 2 wherein the dispensing package (10) is unitarily formed from a selected plastic sheet material.

6. The dispensing package (10) specified in claim 2 wherein the dispensing package (10) is unitarily formed by a thermoforming process from a selected plastic sheet material.

* * * * *